US011761164B2

(12) United States Patent
Hafford

(10) Patent No.: US 11,761,164 B2
(45) Date of Patent: Sep. 19, 2023

(54) METHOD FOR FORMING A FOUNDATION WALL

(71) Applicant: TC Hafford Basement Systems, Wells, ME (US)

(72) Inventor: Tony Hafford, Wells, ME (US)

(73) Assignee: TC HAFFORD BASEMENT SYSTEMS, Wells, ME (US)

( * ) Notice: Subject to any disclaimer, the term of this patent is extended or adjusted under 35 U.S.C. 154(b) by 0 days.

(21) Appl. No.: 17/929,922

(22) Filed: Sep. 6, 2022

(65) Prior Publication Data

US 2022/0412036 A1 Dec. 29, 2022

Related U.S. Application Data

(63) Continuation of application No. 17/082,997, filed on Oct. 28, 2020, now Pat. No. 11,434,618.

(51) Int. Cl.

| | |
|---|---|
| ***E02D 27/48*** | (2006.01) |
| ***E04G 23/02*** | (2006.01) |
| ***E02D 37/00*** | (2006.01) |

(52) U.S. Cl.

CPC ..... *E02D 27/48* (2013.01); *E02D 37/00* (2013.01); *E04G 23/0229* (2013.01)

(58) Field of Classification Search

CPC combination set(s) only.

See application file for complete search history.

(56) References Cited

U.S. PATENT DOCUMENTS

| | | | | |
|---|---|---|---|---|
| 7,419,335 | B1 | 9/2008 | Cohen | |
| 7,774,995 | B1 | 8/2010 | Zidar, Jr. | |
| 8,584,431 | B2 | 11/2013 | Secrest | |
| 9,133,635 | B2 * | 9/2015 | Titcomb | E04G 17/0658 |
| 9,422,734 | B1 | 8/2016 | Heady | |
| 2005/0204673 | A1 | 9/2005 | Reed | |

FOREIGN PATENT DOCUMENTS

| | | |
|---|---|---|
| KR | 101626395 | 6/2016 |
| KR | 101641657 | 7/2016 |
| KR | 101738316 | 5/2017 |

* cited by examiner

*Primary Examiner* — Kyle Armstrong

(74) *Attorney, Agent, or Firm* — Perman & Green, LLP

(57) ABSTRACT

A method for forming a foundation wall of a building structure having a building frame seated on the foundation, the method including coupling each of a plurality of elongated vertical members to a floor of the foundation and the building frame so that each of the vertical members extend between the floor and the building frame adjacent to an existing foundation wall, providing at least one elongated horizontal member through apertures of the vertical members such that the horizontal member extends between and passes through respective ones of the vertical members, coupling panels to the horizontal member so as to form, with the vertical members and the horizontal member an integrated self-supporting formwork which, with the existing foundation wall forms a cavity, having disposed therein, the vertical members and the horizontal member, and flowing concrete into the cavity so as to fill the cavity around the vertical members and horizontal member disposed within the cavity.

20 Claims, 11 Drawing Sheets

METHOD FOR FORMING A FOUNDATION WALL

This application is a continuation of Non-Provisional U.S. patent application Ser. No. 17/082,997, filed Oct. 28, 2020 the disclosures of which is incorporated herein by reference in their entirety.

BACKGROUND

1. Field

The disclosed embodiment generally relates to formworks for placing a concrete foundation wall and, more particularly, to a method of placing concrete foundation walls with one-sided formwork which is partially integrated with the foundation wall.

2. Brief Description of Related Developments

Conventionally, most building foundation structures are constructed by first excavating the earth and then forming the concrete foundation walls in the excavated area. The foundation walls are generally formed with reinforced concrete, for example, by in-situ concrete deposition. The excavation is generally required to remove the ground in an area broader than the size of the desired foundation to be constructed and is performed to a predetermined depth.

Reinforcing steel or other reinforcing material is placed where the foundation walls are intended to be and forms are assembled on both sides of the reinforcements. Concrete is deposited in the cavities defined by the forms to produce the side walls. After the hardening/curing of the concrete within the forms, the forms are disassembled, and space remaining between the outside of the foundation walls and the side of the excavation is back-filled, thereby completing the construction of the foundation.

There is a problem, however, with construction operation involving concreting on-site within an enclosed space where there is limited to no access to one side of the wall, e.g., such as with foundation repair. In these situations, framework is erected on only one side of the wall where the load on the formwork, from the concrete placed/flowed between the framework and the wall, is great requiring significant additional reinforcing structure, such as angled bracing extending from the framework into the ground, to resist bending of the framework under the concrete loading. This additional reinforcing structure increases costs and in some instances requires potential rework.

BRIEF DESCRIPTION OF THE DRAWINGS

The foregoing aspects and other features of the disclosed embodiment are explained in the following description, taken in connection with the accompanying drawings, wherein.

DETAILED DESCRIPTION

As noted above, generally, when placing concrete foundation walls, a pit is excavated to sufficient dimensions to accommodate the planned foundation and allow working space around the exterior of the foundation walls. In some instances, it is not possible to obtain working space on both sides of the planned foundation wall, such as when pouring a secondary wall to reinforce an existing foundation wall with a building structure 998 thereon.

The aspects of the disclosed embodiment provides a novel method for placing a concrete foundation wall with a one-sided, integrated, self-supporting formwork 100 such that a portion of the formwork 100 and reinforced concrete foundation wall 900 (FIG. 8) formed therewith are integrally joined to each other. The aspects of the disclosed embodiment also provide for placing a concrete foundation wall with the one-sided formwork 100 having sufficient strength to hold the placed concrete substantially without additional reinforcing structure (e.g., angled braces extending from the formwork 100 to the ground to counter loading on the formwork by the placed concrete) being added to the formwork.

Figure 1:
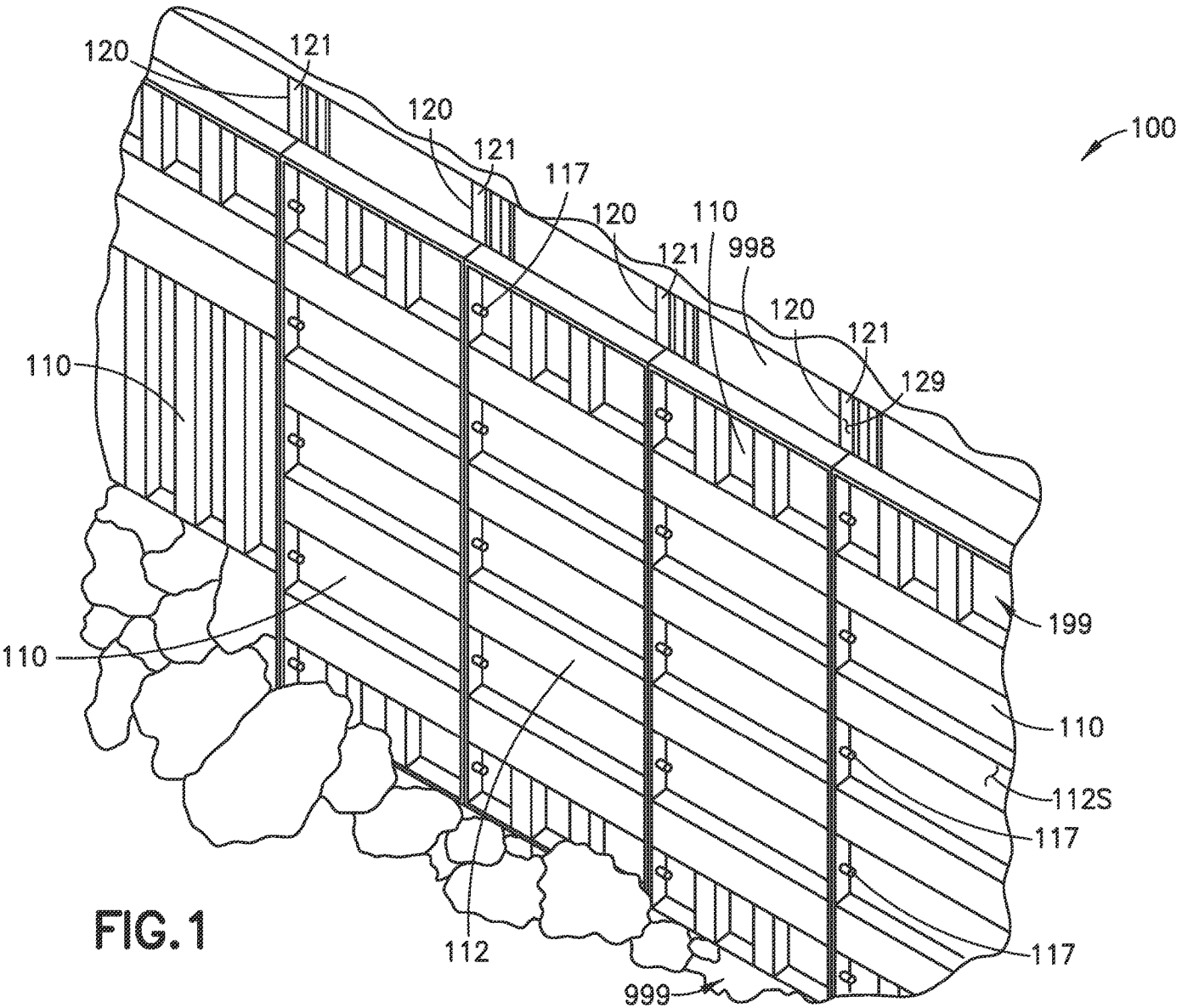
FIG. 1 is an illustration of a formwork in accordance with aspects of the disclosed embodiment.
Figure 2:
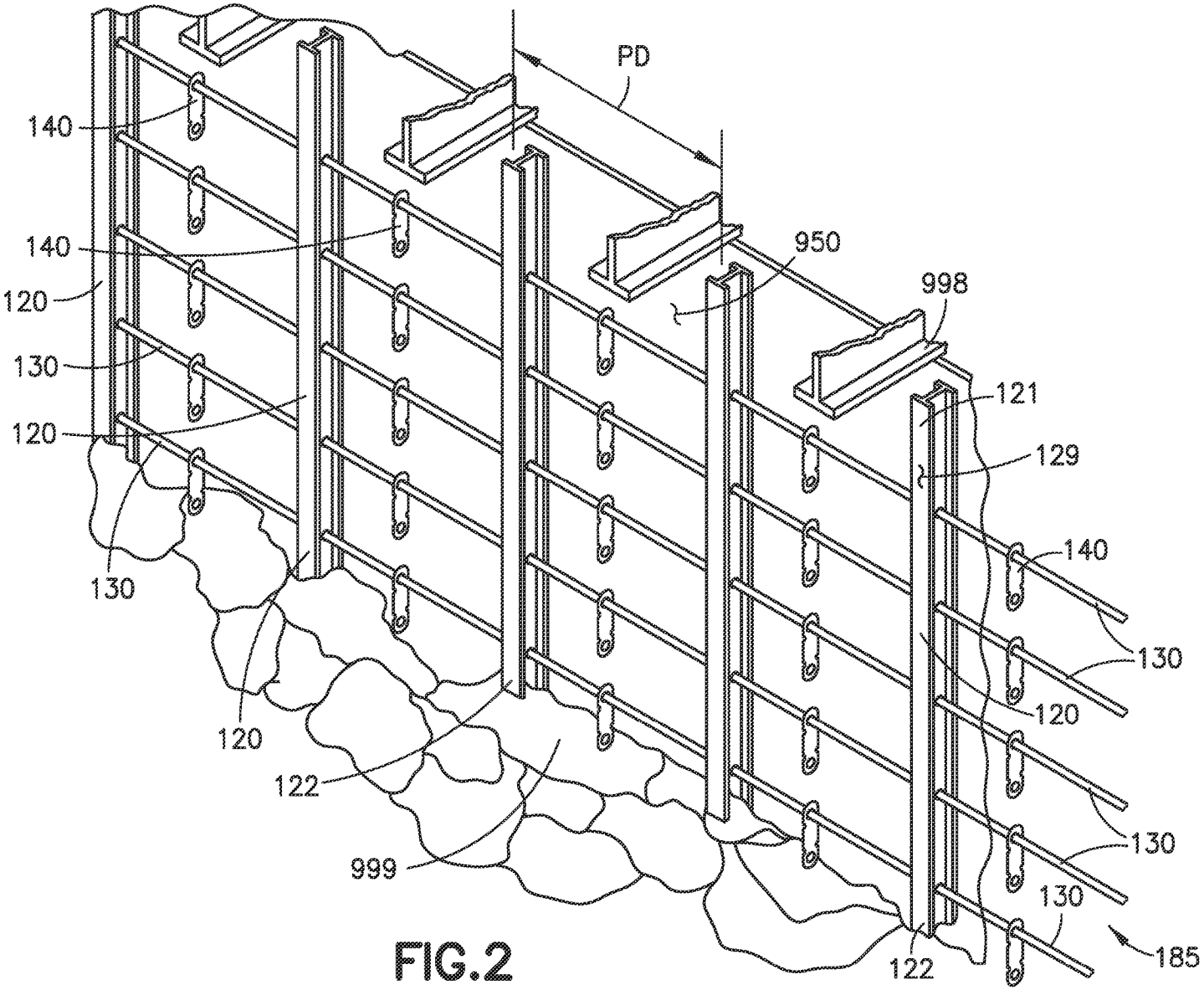
FIG. 2 is an illustration of a portion of the formwork of FIG. 1 in accordance with aspects of the disclosed embodiment.
Figure 3A:
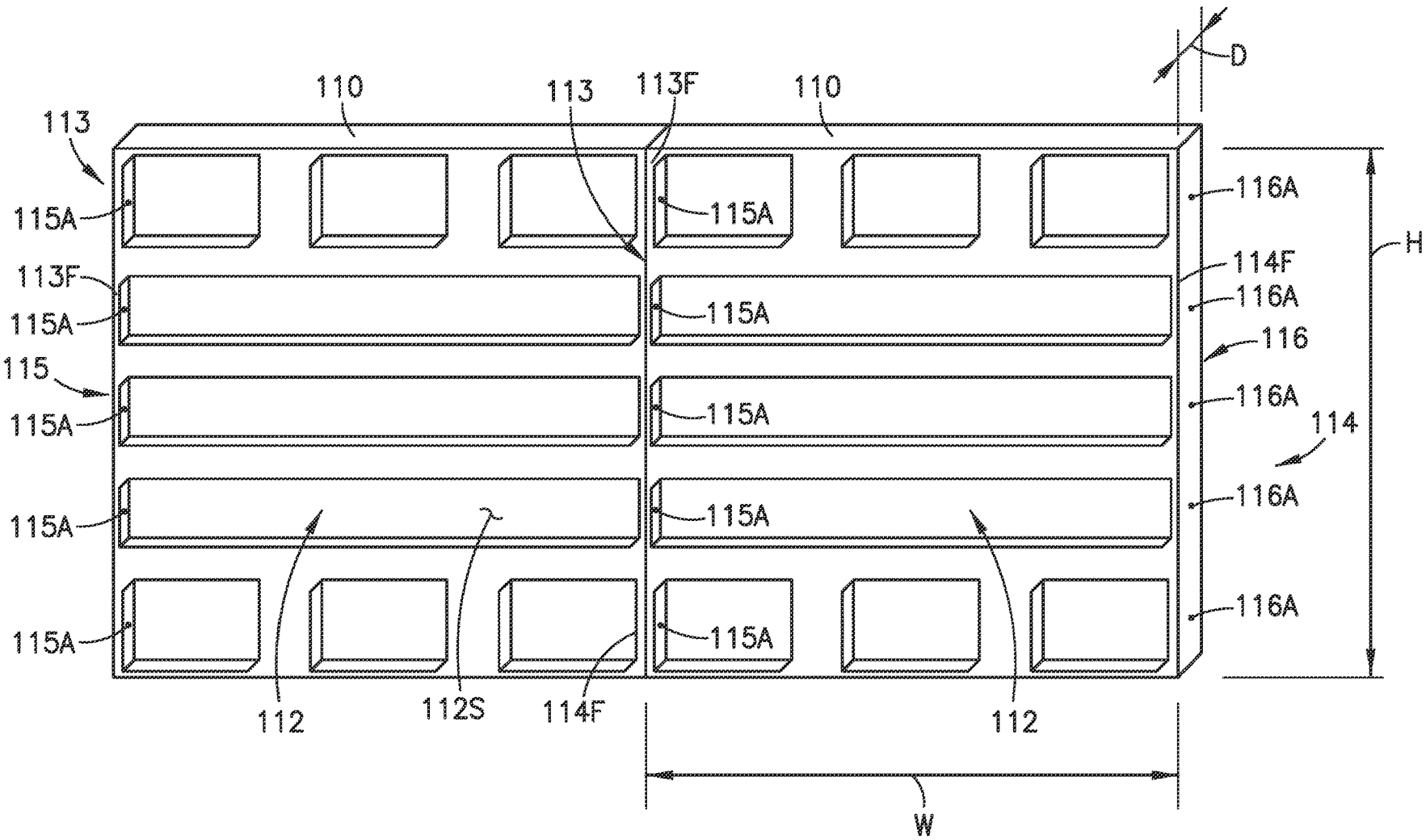
FIGS. 3A and 3B are illustrations of a portion of the formwork of FIG. 1 in accordance with aspects of the disclosed embodiment.
Figure 3B:
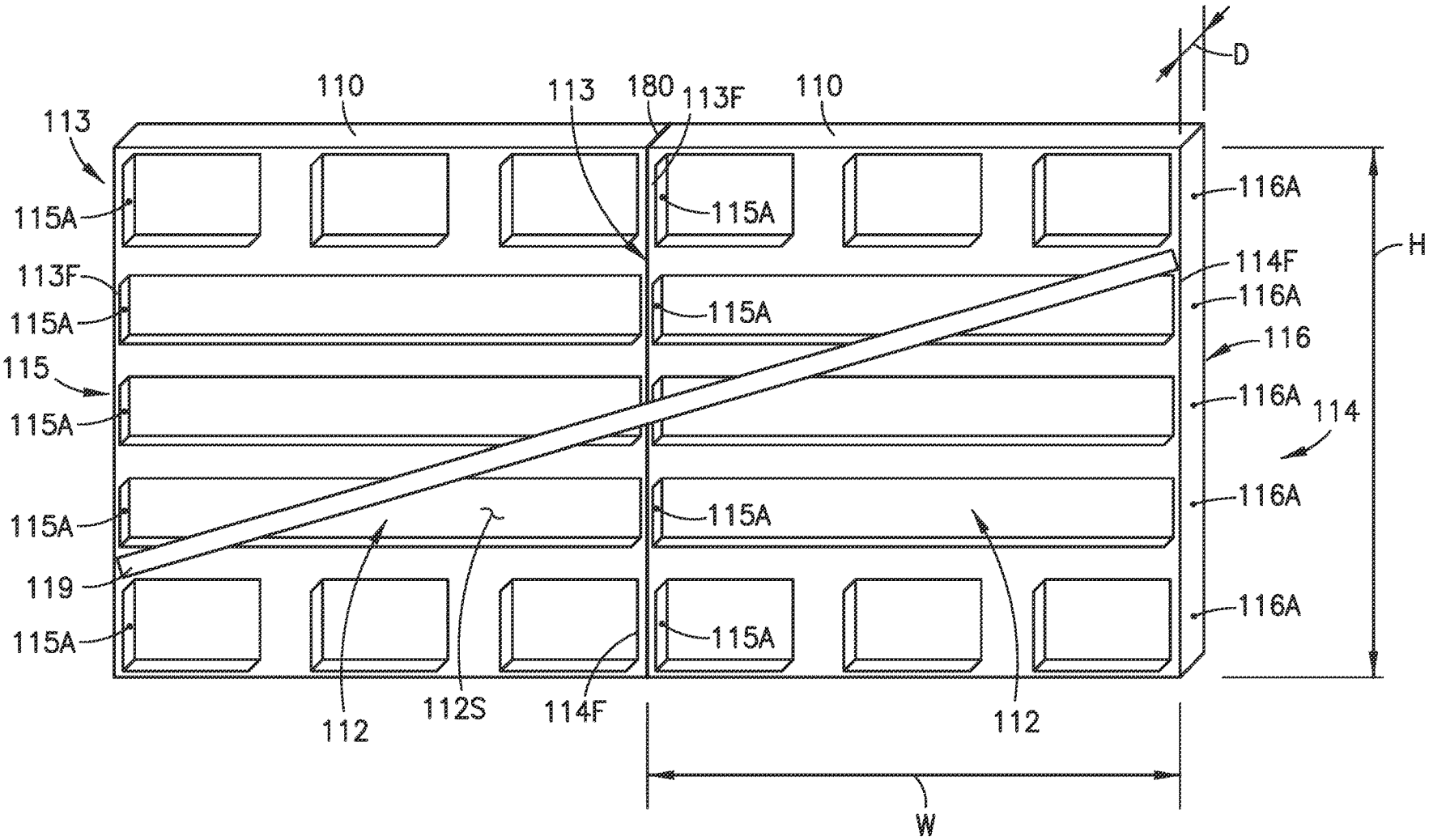
Figure 4:
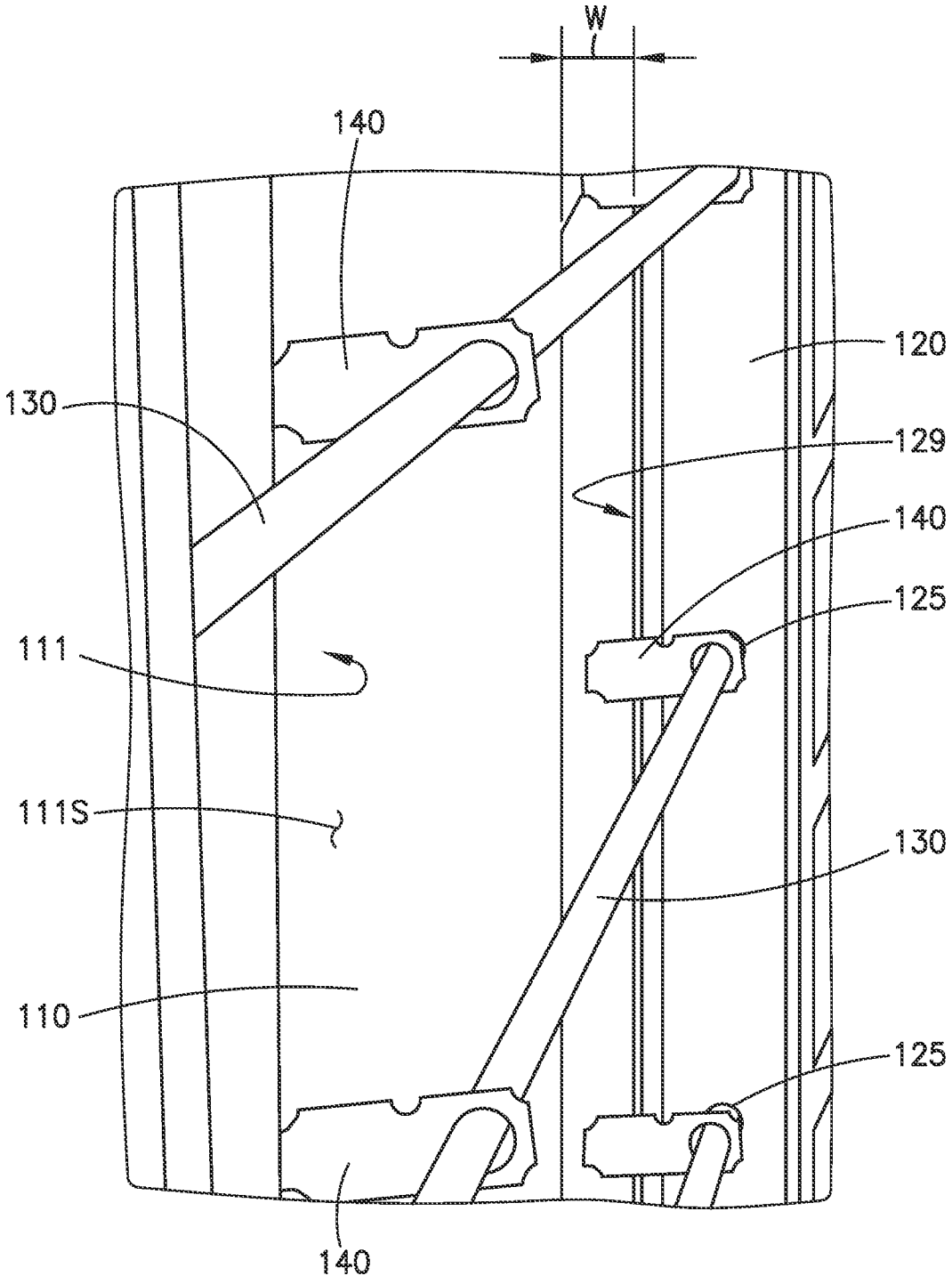
FIG. 4 is an illustration of a portion of the formwork of FIG. 1 in accordance with aspects of the disclosed embodiment.

FIGS. 1 and 2 are schematic illustrations of the integrated, self-supporting formwork 100 in accordance with aspects of the disclosed embodiment. Although the aspects of the disclosed embodiment will be described with reference to the drawings, it should be understood that the aspects of the disclosed embodiment can be embodied in many forms. In addition, any suitable size, shape or type of elements or materials could be used.

Figure 7:
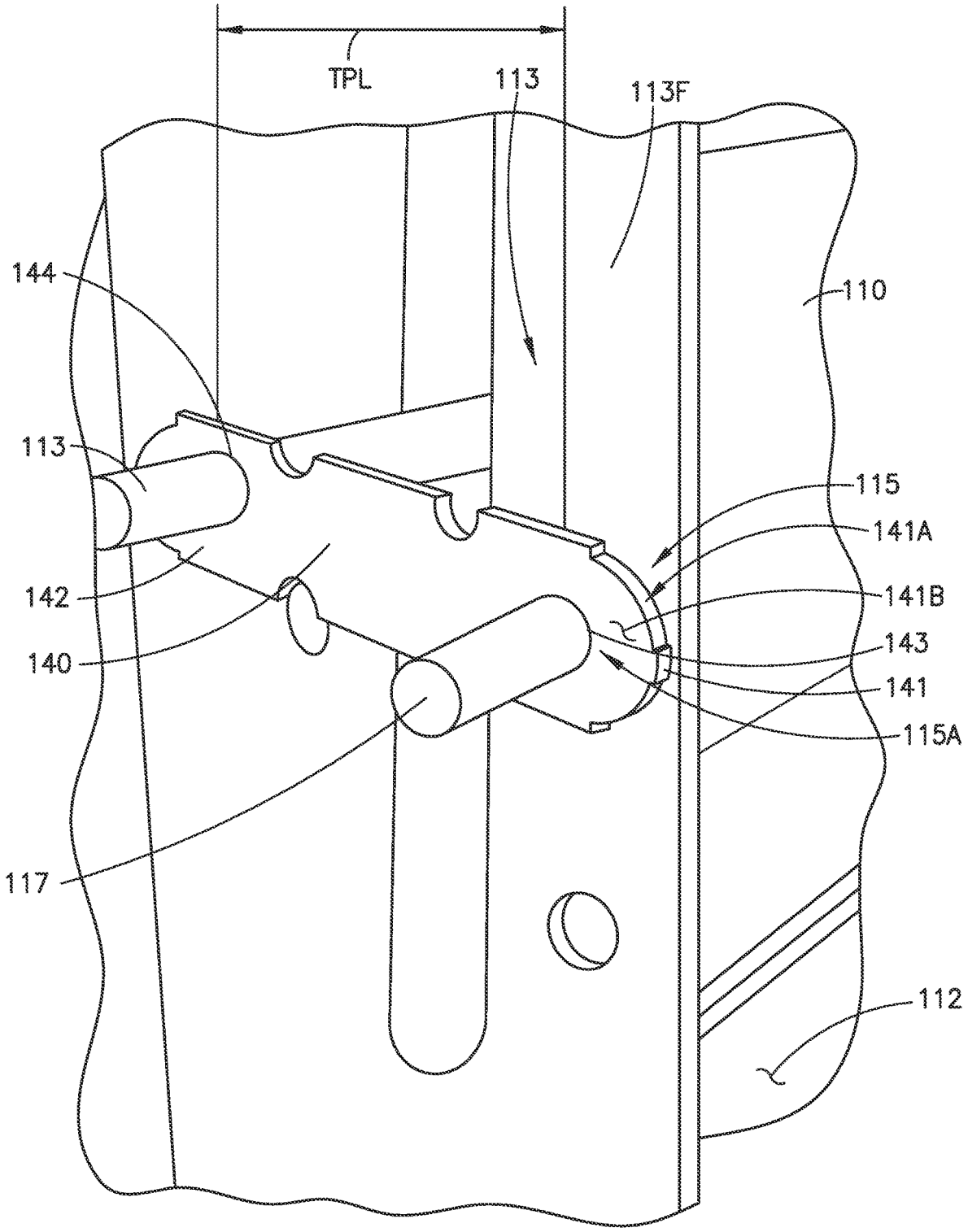
FIG. 7 is an illustration of a portion of the formwork of FIG. 1 in accordance with aspects of the disclosed embodiment.

The formwork 100 includes at least one panel 110, a plurality of elongated vertical members 120, at least one elongated horizontal member 130 (FIG. 2), and ties 140 (FIG. 2; see also FIG. 7). The formwork 100 for placing the concrete foundation wall according to the disclosed embodiment is configured to be partially integrated with the concrete foundation wall and configured such that no lateral bracing is required for loads exerted by the place concrete as will be described below. Moreover, the formwork 100 is configured to be accepted into enclosed spaces such as a basement or crawl space.

Figure 5A:
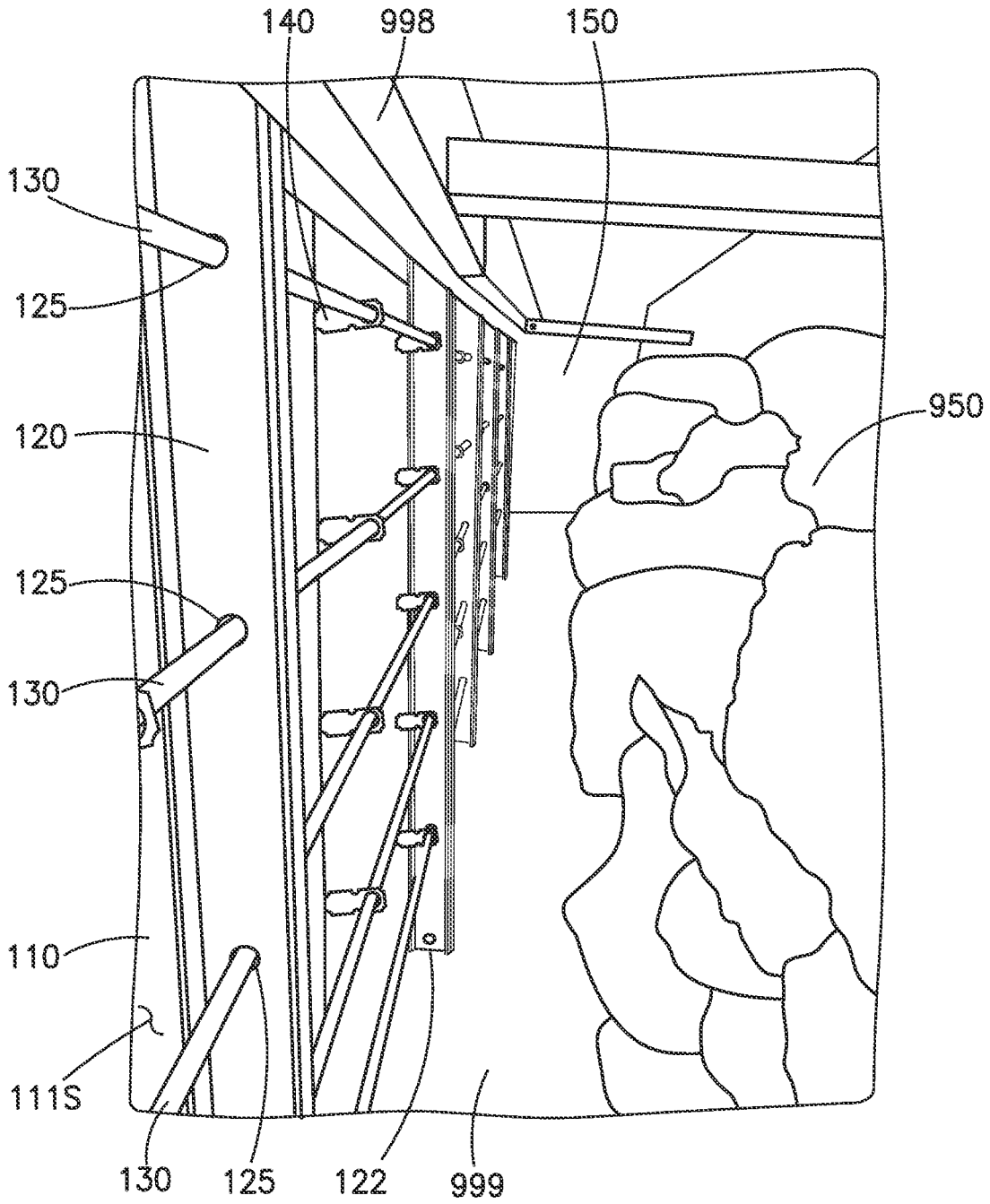
FIGS. 5A and 5B are illustrations of a portion of the formwork of FIG. 1 in accordance with aspects of the disclosed embodiment.
Figure 5B:
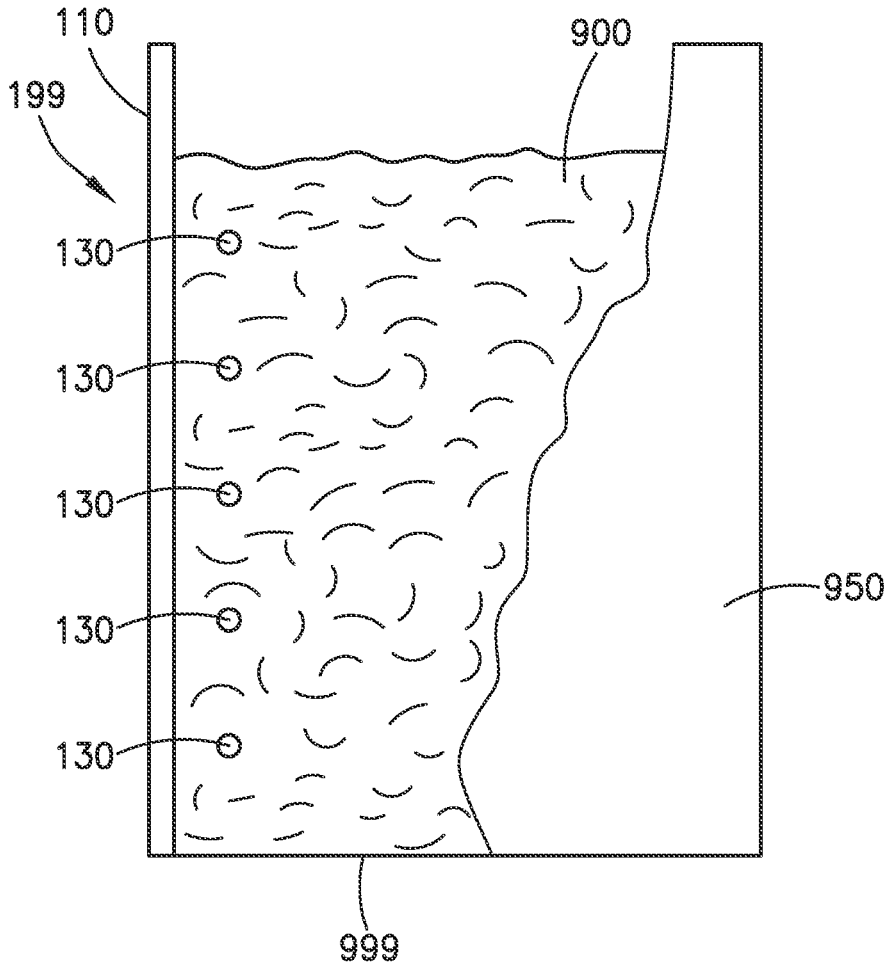

Referring to FIGS. 1, 2, 3A, 3B, and 4, in one aspect of the disclosed embodiment, the panels 110 are configured to be coupled to the at least one elongated horizontal member 130 (FIG. 4) so as to form, with the plurality of elongated vertical members 120 and the at least one elongated horizontal member 130 (as will be described below) an integrated self-supporting formwork 100 which, with the existing foundation wall forms a cavity 150 (FIG. 5), into which cavity 150 the concrete is poured or otherwise placed. The panels 110 are preformed structures made of any suitable material such as, for example, metal, wood, polymer, or any combination thereof. Each panel 110 generally includes at least an interior face 111 (FIG. 4), an exterior face 112, and two vertically extending sides 113, 114. The panels 110 may have any suitable dimensions including any suitable width W, height H, and depth D, depending upon the location and accessibility of the location of the foundation wall. For example, the height H may correspond to an eight foot ceiling height, a ten foot ceiling height, a crawl space height, or any other suitable height so as to be accepted into, e.g., a basement or enclosed space having eight foot ceilings, ten foot ceiling, a crawl space, or any other suitable enclosed space.

In one aspect, the interior and exterior faces 111, 112 have substantially flat surfaces 1115, 112S. In another aspect, the exterior face 112 may include indentations or protrusions such as handles for a user to handle the panels 110 or for attachment of any other suitable accessories such as lights, levels, etc. Each panel 110 includes suitable integrally formed reinforcing members such as one or more stiffening ribs 118 that extend along one or more of the width W and height H of the respective panel 110 so as to provide rigidity and reduce bending of the respective panel 110. The interior face 111 may also include any suitable indentations, protrusions, or texturing for functional or even decorative purposes.

Each individual panel 110 has a first side flange 113F on one of the vertically extending sides 113 and a second side flange 114F on the opposite vertically extending side 114. These side flanges 113F, 114F of each panel 110 include, respectively, a first mating surface 115 and a second mating surface 116 having mating attachment points 115A, 116A (also referred to herein as tie holes for convenience) configured so that two or more panels 110 can be coupled end to end to form a perimeter wall 199 to contain the placed concrete. For example, the mating surfaces 115, 116 are configured so that when mated, the mating surfaces 115, 116 form a suitable seal therebetween to substantially prevent concrete leakage between the surfaces 115, 116 of adjacent panels 110. In one aspect, a seal 180, such as a synthetic rubber strip, is disposed between the mating surfaces 115, 116 of adjacent panels 110 to substantially prevent leakage of the concrete when the concrete is placed. In other aspects, the seals may be omitted such as where surface finish of the mating surfaces 115, 116 is suitable to prevent leaks. In still other aspects, the surfaces 115, 116 may be contoured to form labyrinth seals. The attachment points 115A, 116A may be any suitable coupling or coupling part configured to join or otherwise couple adjacent panels 110. In one aspect the attachment points 115A, 116A are apertures through which any suitable attachment member(s) 117, such as, e.g., pins, bolts, clips, or any other suitable fastener are extended to couple adjacent panels 110. The panels 110 are assembled by placing two panels 110 side-by-side (e.g., in an end-to-end arrangement) so as to align the attachment points 115A, 116A and securing the panels 110 to one another with the attachment member(s) 117 (e.g., received in the aligned attachment points 115A, 116A in the side flanges 113F, 114F of the panels 110). The attachment points 115A, 116A are located at any suitable predetermined intervals or spacing so that the ends of the two panels 110 can be securely joined together by any suitable attachment member(s) 117.

In one aspect, the panels 110 may include an external rib 119 (FIG. 3B) for obliquely connecting the panels 110 to each other. The ribs 119 may be is formed in a substantially V shape, in a substantially X shape across the perimeter wall 199, or in any other suitable manner to connect the panels 110.

Referring to FIGS. 2, 4, 5, and 6A-6C, the plurality of elongated vertical members 120 are configured to couple to a floor 999 of the foundation and the building frame 998 (such as coupling to, e.g., floor/ceiling joists, bearers that support floor/ceiling joists, etc.) so that each of the plurality of elongated vertical members 120 extends between and is coupled to both the floor 999 and the building frame 998 as will be described herein. In one aspect, the plurality of elongated vertical members 120 are coupled to the floor 999 and frame 998 adjacent to an existing foundation wall 950 to form the cavity 150 into which concrete is placed. For example, the plurality of elongated vertical members 120 may be any suitable height that corresponds to, e.g., an eight foot ceiling height, a ten foot ceiling height, a crawl space height, or any other suitable height so as to be accepted into, e.g., a basement or enclosed space having, e.g., eight foot ceilings, ten foot ceiling, a crawl space, or any other suitable enclosed space. Each of the plurality of elongated vertical members 120 include a first end 121, a second end 122, and apertures 125 (FIG. 5) configured to accept the at least one elongated horizontal member 130 as will be described below.

The plurality of elongated vertical members 120 are generally spaced apart from one another by any suitable predetermined distance PD, such as, about five feet apart although in other aspects, the plurality of elongated vertical members 120 may be placed closer than five feet apart or further than five feet apart. The plurality of elongated vertical members 120, in combination with the at least one elongated horizontal member 130, are configured to support the panels 110. Each of the plurality of elongated vertical members 120 is sufficiently rigid so as to support the panels 110 and retain the panels 110, relative to the existing foundation wall 950, substantially without bending or buckling under loads exerted on the panels 110 by the concrete placed in the cavity 150 where concrete typically weighs about 4500 lbs per cubic yard. As can be seen in FIG. 2, the plurality of elongated vertical members 120 and the at least one elongated horizontal member 130 form an in-situ support grid that supports the panels substantially without external lateral bracing such as that described above. The plurality of elongated vertical members 120 have any suitable shape and size so as to securely couple with the floor 999 and frame 998. For example, the plurality of elongated vertical members 120 have any suitable cross section, such as, a square or rectangular hollow structural beam, an I beam, a T beam, an L beam, a c-channel, or any other suitable cross-sectional shape and be constructed of any suitable material having any suitable wall thickness for retaining the panels 110 against loading by the concrete within the cavity 150.

Figure 6A:
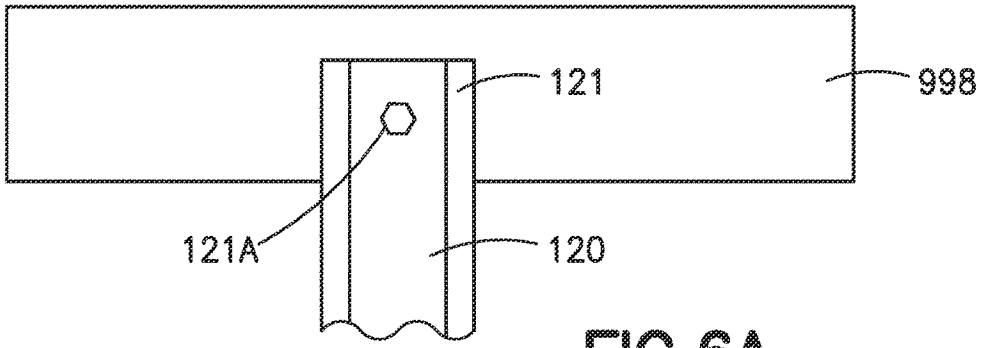
FIGS. 6A, 6B, and 6C are illustrations of a portion of the formwork of FIG. 1 in accordance with aspects of the disclosed embodiment.
Figure 6B:
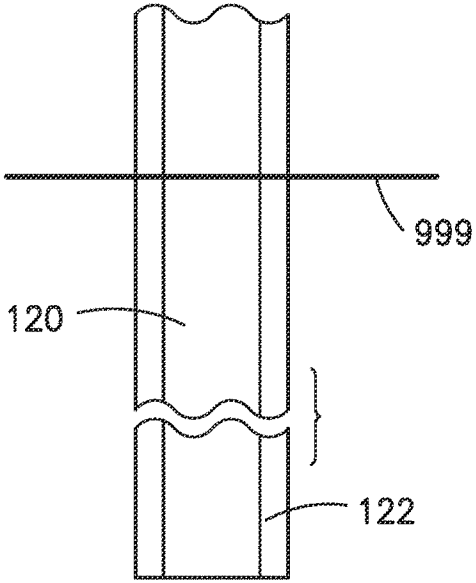
Figure 6C:
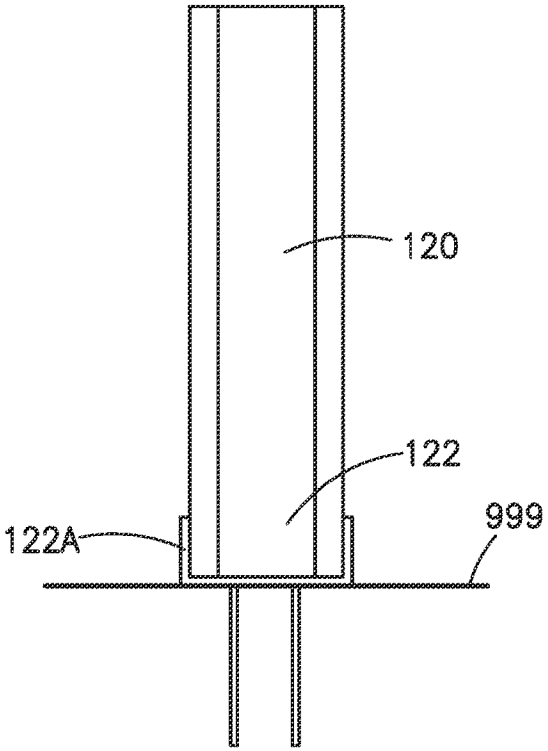
Figure 8:
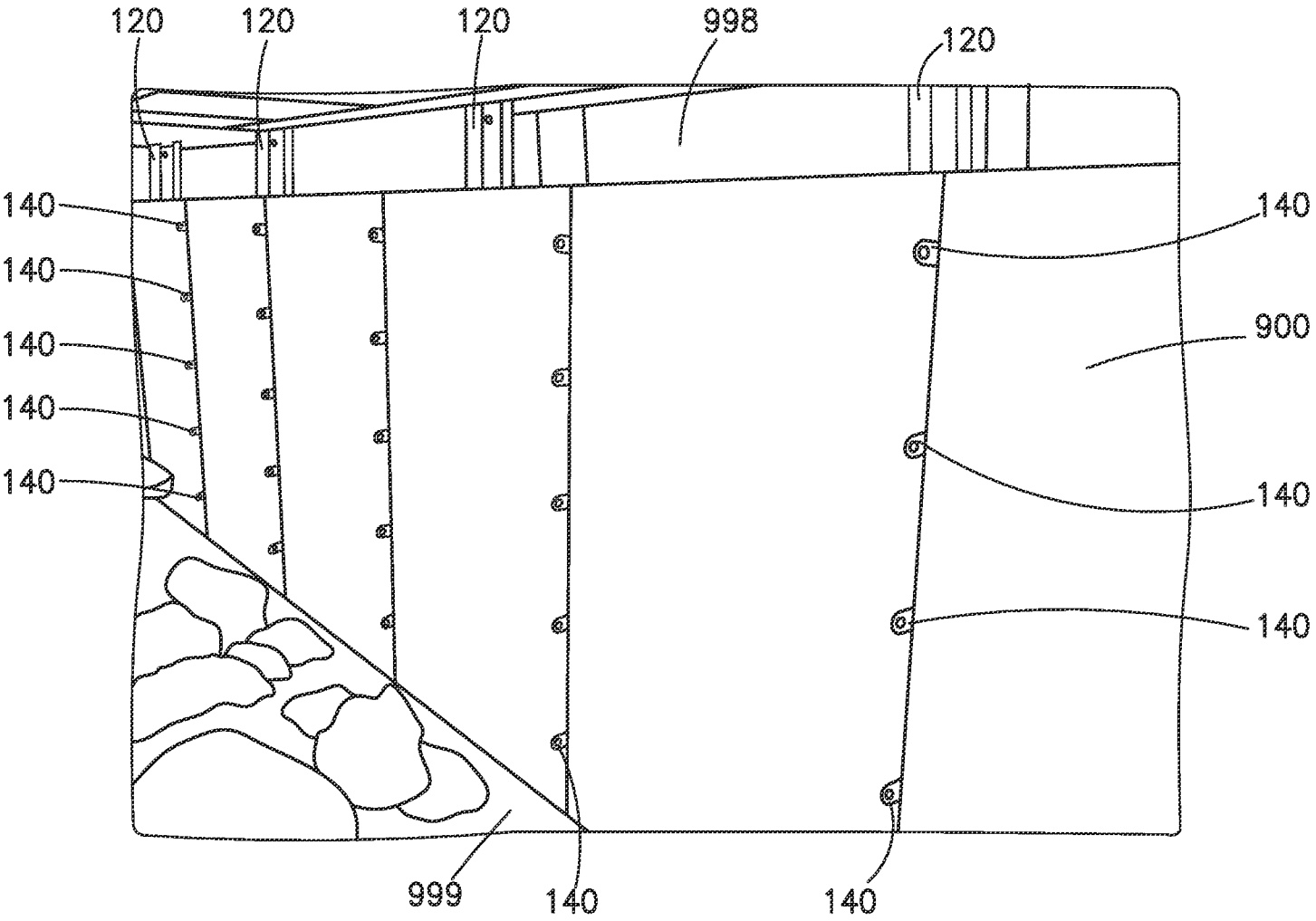
FIG. 8 is an illustration of a concrete foundation wall with the formwork of FIG. 1 integrated in accordance with aspects of the disclosed embodiment.

Referring particularly to FIG. 6A, in one aspect, the first end 121 of each plurality of elongated vertical members 120 is configured to couple to the building frame 998. The first end 121 includes an aperture 121A which is configured to receive any suitable fastener to couple the first end 121 to the building frame 998 (e.g., any suitable fastener such as a lag bolt, a bracket, a bolt, or any other suitable fastener). As seen in FIGS. 6B and 6C, the second end 122 is configured to couple to the floor 999. For example, the second end 122 may be coupled to the floor 999 with any suitable anchor 122A such as an earth anchor, a c-bracket, or any other suitable anchor (FIG. 6C) and/or may be buried a predetermined depth beneath the floor 999 (FIG. 6B) to support the loads exerted on the formwork 100 by the concrete within the cavity 150. The first and second ends 121, 122 coupled to the building frame 998 and floor 999 form with the at least one elongated horizontal member 130 a tied structural system that forms the in-situ support grid (FIG. 2) that is integral to the perimeter wall 199 and a portion of which remains integral to the reinforced concrete foundation wall 900 (FIG. 8).

The plurality of elongated vertical members 120 may be further defined as having a panel facing side 129 that may be positioned directly on the interior face 111 of the panel 110 or spaced apart from the interior face 111 of the panel 110 by any suitable distance SW so that concrete is allowed to flow between the interior face 111 and the panel facing side 129. Having the plurality of elongated vertical members 120 spaced from the interior face 111 be distance SW allows the concrete to surround the plurality of elongated vertical members 120 so that after hardening/curing the concrete, the plurality of elongated vertical members 120 and the at least one elongated horizontal member 130 are firmly integrated with the cured concrete (i.e., integral to the reinforced concrete foundation wall 900) to form the reinforced foundation wall structure 900 (FIG. 8).

Referring to FIGS. 2, 4, 5, and 7, the at least one elongated horizontal member 130 is configured to extend through the apertures 125 of the plurality of elongated vertical members 120 such that the at least one elongated horizontal member 130 extends between and passes through respective ones of the plurality of elongated vertical members 120 to form the reinforcing grid 185. In one aspect, the at least one elongated horizontal member 130 is rebar or any other suitable reinforcement member configured to, for example, strengthen and aid concrete under tension. The at least one elongated horizontal member 130 is positioned to extend the length of the desired foundation wall 900. The at least one elongated horizontal member 130 and the plurality of elongated vertical members 120 can collectively be arranged in a grid-like configuration as noted above (FIG. 2). The at least one elongated horizontal member 130 provides tie or coupling points between adjacent vertical members 120 for the panels 110 to tie into or otherwise couple to the reinforcing grid 185 the structure as will be described below. While the exemplary embodiment illustrated in, e.g., FIG. 2 has five elongated horizontal members 130 spaced apart from each other in a vertically spaced arrangement, any number of elongated horizontal members 130 can be employed and vertically spaced apart from one another with any suitable vertical spacing.

Referring to FIG. 7, the formwork 100 further includes tie plates 140. The tie plates 140 include a first tie end 141 and a second tie end 142. The first tie end 141 includes an aperture 143 configured such that the attachment member 117 passes through the tie plate 140 when securing the flange 113F of one panel to the flange 114F of another panel. The first tie end 141 has a first face 141A and a second face 141B which are each configured to interface with a respective flange 113F, 114F. The second tie end 142 includes aperture 144 which is configured to receive the at least one elongated horizontal member 130. With the first end coupled between the panels 110 with attachment member 117 and the second tie end 142 coupled to the at least one elongated horizontal member 130, the tie plate 140 effectively couples the panels 110 to the horizontal members 130 and thus the vertical members 120 (e.g., the tie plates 140 couple the panels 110 to the reinforcing grid formed by the at least one elongated horizontal member 130 and the plurality of elongated vertical members 120). The tie plates 140 have any suitable length TPL that defines the spacing SW or lack thereof between the interior face 111 of the panel 110 and the panel facing side 129 of the plurality of elongated vertical members. The tie plates 140 are constructed of any suitable material that provides for the removal of an exposed portion of the tie plates 140 that protrudes from the reinforced concrete foundation wall 900 (see FIG. 8).

Figure 9:
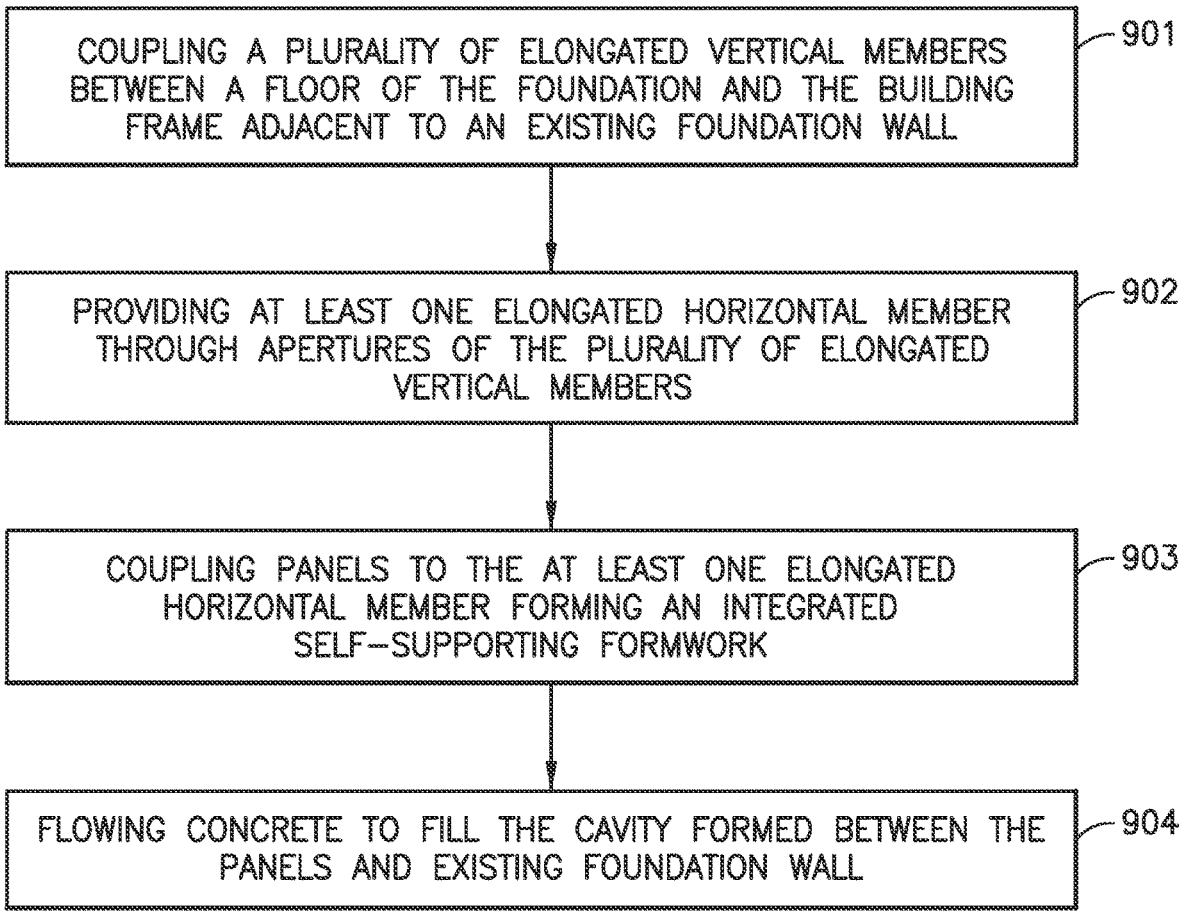
FIG. 9 is a method of constructing a concrete foundation wall with the formwork of FIG. 1 in accordance with aspects of the disclosed embodiment.

Referring now to FIG. 9, a method for forming a foundation wall of a building structure having a building frame seated on the foundation is illustrated. The method includes coupling each of a plurality of elongated vertical members 120 to a floor 999 of the foundation and the building frame 998 (FIG. 9, Block 901) seated on the foundation so that each of the plurality of elongated vertical members 120 extend between the floor 999 and the building frame 998 adjacent to an existing foundation wall 950. At least one elongated horizontal member 130 is provided through apertures 125 of the plurality of elongated vertical members 120 (FIG. 9, Block 902) such that the at least one elongated horizontal member 130 extends between and passes through respective ones of the plurality of elongated vertical members 120. Panels 110 are coupled to the at least one elongated horizontal member 130 (FIG. 9, Block 903) so as to form, with the plurality of elongated vertical members 120 and the at least one elongated horizontal member 130 an integrated self-supporting formwork 100 which, with the existing foundation wall forms a cavity 150, having disposed therein, the plurality of elongated vertical members 120 and the at least one elongated horizontal member 130. With the panels 110 positioned, concrete is placed or otherwise caused to flow into the cavity 150 (FIG. 9, Block 904) so as to fill the cavity 150 and flow around the plurality of elongated vertical members 120 and at least one elongated horizontal member 130 disposed within the cavity 150.

In accordance with the aspects of the disclosed embodiment a method for forming a foundation wall of a building structure having a building frame seated on the foundation is provided. The method including coupling each of a plurality of elongated vertical members to a floor of the foundation and the building frame so that each of the plurality of elongated vertical members extend between the floor and the building frame adjacent to an existing foundation wall, providing at least one elongated horizontal member through apertures of the plurality of elongated vertical members such that the at least one elongated horizontal member extends between and passes through respective ones of the plurality of elongated vertical members, coupling panels to the at least one elongated horizontal member so as to form, with the plurality of elongated vertical members and the at least one elongated horizontal member an integrated self-supporting formwork which, with the existing foundation wall forms a cavity, having disposed therein, the plurality of elongated vertical members and the at least one elongated horizontal member, and flowing concrete into the cavity so as to fill the cavity around the plurality of elongated vertical members and at least one elongated horizontal member disposed within the cavity.

In accordance with the aspects of the disclosed embodiment the at least one elongated horizontal member are rebar.

In accordance with the aspects of the disclosed embodiment the plurality of elongated vertical members are metal.

In accordance with the aspects of the disclosed embodiment the panels are couple to the at least one elongated horizontal member with a tie plate.

In accordance with the aspects of the disclosed embodiment the plurality of elongated vertical members are spaced apart a predetermined distance relative to one another.

In accordance with the aspects of the disclosed embodiment the plurality of elongated vertical members are spaced about 5 feet apart.

In accordance with the aspects of the disclosed embodiment further including drilling holes to form the apertures through the plurality of elongated vertical members so as to extend the at least one elongated horizontal member through the plurality of elongated vertical members.

In accordance with the aspects of the disclosed embodiment the at least one elongated horizontal member and the plurality of elongated vertical members are arranged in a grid configuration expanding a length of the foundation wall.

In accordance with the aspects of the disclosed embodiment the grid configuration is braceless in a lateral direction relative to the length of the foundation wall.

In accordance with the aspects of the disclosed embodiment the apertures correspond to tie holes on the panels to couple the panels to the at least one elongated horizontal member.

In accordance with the aspects of the disclosed embodiment the integrated self-supporting formwork is configured so as to be accepted into an enclosed space.

In accordance with the aspects of the disclosed embodiment a method for forming a basement wall of a building foundation having a building frame seated on the building foundation is provided. The method including coupling each of a plurality of elongated vertical members to a floor of the foundation and the building frame so that each of the plurality of elongated vertical members extend between the floor and the building frame, providing at least one elongated horizontal member to the plurality of elongated vertical members such that the at least one elongated horizontal member extends between respective ones of the plurality of elongated vertical members, coupling at least one panel to the at least one elongated horizontal member so as to form, with the plurality of elongated vertical members and the at least one elongated horizontal member an integrated self-supporting formwork defining at least part of a cavity having disposed therein the plurality of elongated vertical members and the at least one elongated horizontal member, and flowing concrete into the cavity so as to fill the cavity around the plurality of elongated vertical members and at least one elongated horizontal member disposed within the cavity.

In accordance with the aspects of the disclosed embodiment the at least one elongated horizontal member are rebar.

In accordance with the aspects of the disclosed embodiment the plurality of elongated vertical members are metal.

In accordance with the aspects of the disclosed embodiment the panels are couple to the at least one elongated horizontal member with a tie plate.

In accordance with the aspects of the disclosed embodiment the plurality of elongated vertical members are spaced apart a predetermined distance relative to one another.

In accordance with the aspects of the disclosed embodiment the plurality of elongated vertical members are spaced about 5 feet apart.

In accordance with the aspects of the disclosed embodiment further including drilling holes to form the apertures through the plurality of elongated vertical members so as to extend the at least one elongated horizontal member through the plurality of elongated vertical members.

In accordance with the aspects of the disclosed embodiment the at least one elongated horizontal member and the plurality of elongated vertical members are arranged in a grid configuration expanding a length of the foundation wall.

In accordance with the aspects of the disclosed embodiment the grid configuration is braceless in a lateral direction relative to the length of the foundation wall.

In accordance with the aspects of the disclosed embodiment the apertures correspond to tie holes on the panels to couple the panels to the at least one elongated horizontal member.

In accordance with the aspects of the disclosed embodiment the integrated self-supporting formwork is configured so as to be accepted into an enclosed space.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

What is claimed is:

1. A system for forming a foundation wall of a building structure having a building frame seated on the foundation, the system comprising:

a plurality of elongated vertical members configured to couple to each of a floor of the foundation and the building frame so that each of the plurality of elongated vertical members extend between the floor and the building frame adjacent to an existing foundation wall;

at least one elongated horizontal member provided through apertures of the plurality of elongated vertical members such that the at least one elongated horizontal member extends continuously between and passes through each respective ones of the plurality of elongated vertical members so that the at least one elongated horizontal member connects each respective one of the plurality of elongated vertical members to each other; and panels configured to couple to the at least one elongated horizontal member so as to form, with the plurality of elongated vertical members and the at least one elongated horizontal member, an integrated self-supporting formwork which, with the existing foundation wall forms a cavity, having disposed therein, the plurality of elongated vertical members and the at least one elongated horizontal member, so that concrete flowed into the cavity fills the cavity around the plurality of elongated vertical members and at least one elongated horizontal member disposed within the cavity.

2. The system of claim 1, wherein the at least one elongated horizontal member are rebar.

3. The system of claim 1, wherein the plurality of elongated vertical members are metal.

4. The system of claim 1, wherein the panels are couple to the at least one elongated horizontal member with a tie plate.

5. The system of claim 1, wherein the plurality of elongated vertical members are spaced apart a predetermined distance relative to one another.

6. The system of claim 1, wherein the plurality of elongated vertical members are spaced 5 feet apart.

7. The system of claim 1, wherein the at least one elongated horizontal member and the plurality of elongated vertical members are arranged in a grid configuration expanding a length of the foundation wall.

8. The system of claim 7, wherein the grid configuration is braceless in a lateral direction relative to the length of the foundation wall.

9. The system of claim 1, wherein the apertures correspond to tie holes on the panels to couple the panels to the at least one elongated horizontal member.

10. The system of claim 1, wherein the integrated self-supporting formwork is configured so as to be accepted into an enclosed space.

11. A system for forming a basement wall of a building foundation having a building frame seated on the building foundation, the system comprising:

a plurality of elongated vertical members coupled to each of a floor of the foundation and the building frame so that each of the plurality of elongated vertical members extend between the floor and the building frame;

at least one elongated horizontal member provided to the plurality of elongated vertical members such that the at least one elongated horizontal member extends continuously between each respective one of the plurality of elongated vertical members so that the at least one elongated horizontal member connects each respective one of the plurality of elongated vertical members to each other; and at least one panel coupled to the at least one elongated horizontal member so as to form, with the plurality of elongated vertical members and the at least one elongated horizontal member an integrated self-supporting formwork defining at least part of a cavity having disposed therein the plurality of elongated vertical members and the at least one elongated horizontal member, so that concrete flowed into the cavity fills the cavity around the plurality of elongated vertical members and at least one elongated horizontal member disposed within the cavity.

12. The system of claim 11, wherein the at least one elongated horizontal member are rebar.

13. The system of claim 11, wherein the plurality of elongated vertical members are metal.

14. The system of claim 11, wherein the panels are couple to the at least one elongated horizontal member with a tie plate.

15. The system of claim 11, wherein the plurality of elongated vertical members are spaced apart a predetermined distance relative to one another.

16. The system of claim 11, wherein the plurality of elongated vertical members are spaced 5 feet apart.

17. The system of claim 11, wherein the at least one elongated horizontal member and the plurality of elongated vertical members are arranged in a grid configuration expanding a length of the foundation wall.

18. The system of claim 17, wherein the grid configuration is braceless in a lateral direction relative to the length of the foundation wall.

19. The system of claim 11, wherein the apertures correspond to tie holes on the panels to couple the panels to the at least one elongated horizontal member.

20. The system of claim 11, wherein the integrated self-supporting formwork is configured so as to be accepted into an enclosed space.

* * * * *